United States Patent [19]

Shibla

[11] 4,160,285

[45] Jul. 3, 1979

[54] POINT LOCATING APPARATUS

[76] Inventor: James N. Shibla, 78 Aronimink Pl., Macungie, Pa. 18062

[21] Appl. No.: 823,895

[22] Filed: Aug. 12, 1977

[51] Int. Cl.[2] ..... F21S 1/02

[52] U.S. Cl. ..... 362/145; 362/147; 362/259; 362/275; 362/287; 362/432

[58] Field of Search ..... 362/145, 147, 259, 275, 362/287, 432

[56] References Cited

U.S. PATENT DOCUMENTS

| | | | |
|---|---|---|---|
| 3,116,022 | 12/1963 | Davis | 362/275 X |
| 3,392,274 | 7/1968 | Neely et al. | 362/275 X |

*Primary Examiner*—Stephen J. Lechert, Jr.
*Attorney, Agent, or Firm*—Michael F. Petock

[57] ABSTRACT

A point locating apparatus is disclosed for precisely locating a point from a known point where the position of the point to be located has been previously known. The apparatus of the present invention may be used to repeatedly locate an object, such as an oil fill pipe, once its position is originally known even though the location of the object on subsequent occasions may be obscured from view. The apparatus includes a bracket which may be mounted at a fixed point, such as on the wall of a building, and a collimated light source which may be removably mounted on the bracket. The bracket includes a keyed mounting structure which is at least partially rotatable in two orthogonal directions, thereby allowing adjustment to point the collimated light source in the direction of the object to be repeatedly located on subsequent occasions. The bracket is provided with structure for locking the keyed mounting structure in the selected rotated position which allows the collimated light source to point in the direction of the object to be located.

10 Claims, 4 Drawing Figures

POINT LOCATING APPARATUS

BACKGROUND OF THE INVENTION

The present invention relates to a point locating apparatus. More particularly, the present invention relates to a point locating apparatus which provides a high degree of precision in locating the point or object to be located.

There has been a need for a means of locating objects at reoccuring, but infrequent, intervals. For example, heating oil deliverymen often have a problem in locating the oil fill pipe. This problem may occur at any time due to the lack of familiarity of the deliveryman with the particular premises and the fact that the oil fill pipe may be obscured from view by various things such as shubbery and high grass. However, the problem is particularly acute during the fall and winter months when it may be obscured by leaves on the ground, snow, and ice.

The present invention provides apparatus for relocating a point on subsequent occasions for all types of uses. For example, the apparatus of the present invention may be used to locate gas and water controls or connections. The present invention may also be used to locate the point at which objects are buried, such as the opening in a septic tank cover which may have to be located periodically in order to pump sludge. The present invention may be used in any application where the location of the object is originally known, and must be located at a later date with precision.

Certain mechanical devices have been known in the past to try to solve this problem. For example, U.S. Pat. Nos. 2,770,042 and 2,068,822 both disclose compasses provided with tape measures. The compases are mounted on a structure or fixed point. The compasses are set to a desired angle, and the distance measured to the point. However, these have been fairly inexact in that they only provide a bearing in a single plane. The point to be located requires directional information in two orthogonal directions. The prior art devices provide positioning information only where the point to be located is in the same plane as the mounting position. Even then, the tape measure tends to bend and flex, thereby failing to provide a precise locating of the point to be located, even if the object to be located were in the same plane as the compass. Further, these prior art devices required the maintaining of a record of the bearing angle and distance to the object to be located. If this information were removed, lost or otherwise unavailable, the apparatus was of no assistance in locating the object.

SUMMARY OF THE INVENTION

The present invention provides a means of precisely locating a point on subsequent occasions where the location of the point has been previously known. The present invention provides a means of locating objects at a large number of different locations where the investment of apparatus at each location is relatively small.

The present invention advantageously provides a collimated light ray which points precisely to the object to be located when the collimated light source is mounted on a pre-set bracket.

Briefly, in accordance with the present invention, apparatus for locating a point from a known point is provided. The apparatus includes a bracket means adapted for mounting at a known point, such as on a building or other structure in the area of the point to be located. The bracket means includes a keyed mounting means which is at least partially rotatable in two orthogonal directions. The bracket means includes means for locking the keyed mounting means in a selected rotated position. A collimated light source is provided which may be removably mounted on the keyed mounting means.

In operation, when the location of the point to be subsequently located is known, a bracket is mounted on the building or other structure in the vicinity. The collimated light source is mounted on the keyed mounting means and directed to the point to be located at a later date. Once the collimated light source is pointed so that the collimated light is shining on the object to be located, the rotatable keyed mounting means is locked in that position. The collimated light source, which may preferably be a laser, is removed and taken with the person. When it is desired at a later time, to again locate the point, the collimated light source is mounted on the pre-set keyed mounting means of the bracket means and the collimated light will illuminate or shine on the object or point to be located.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
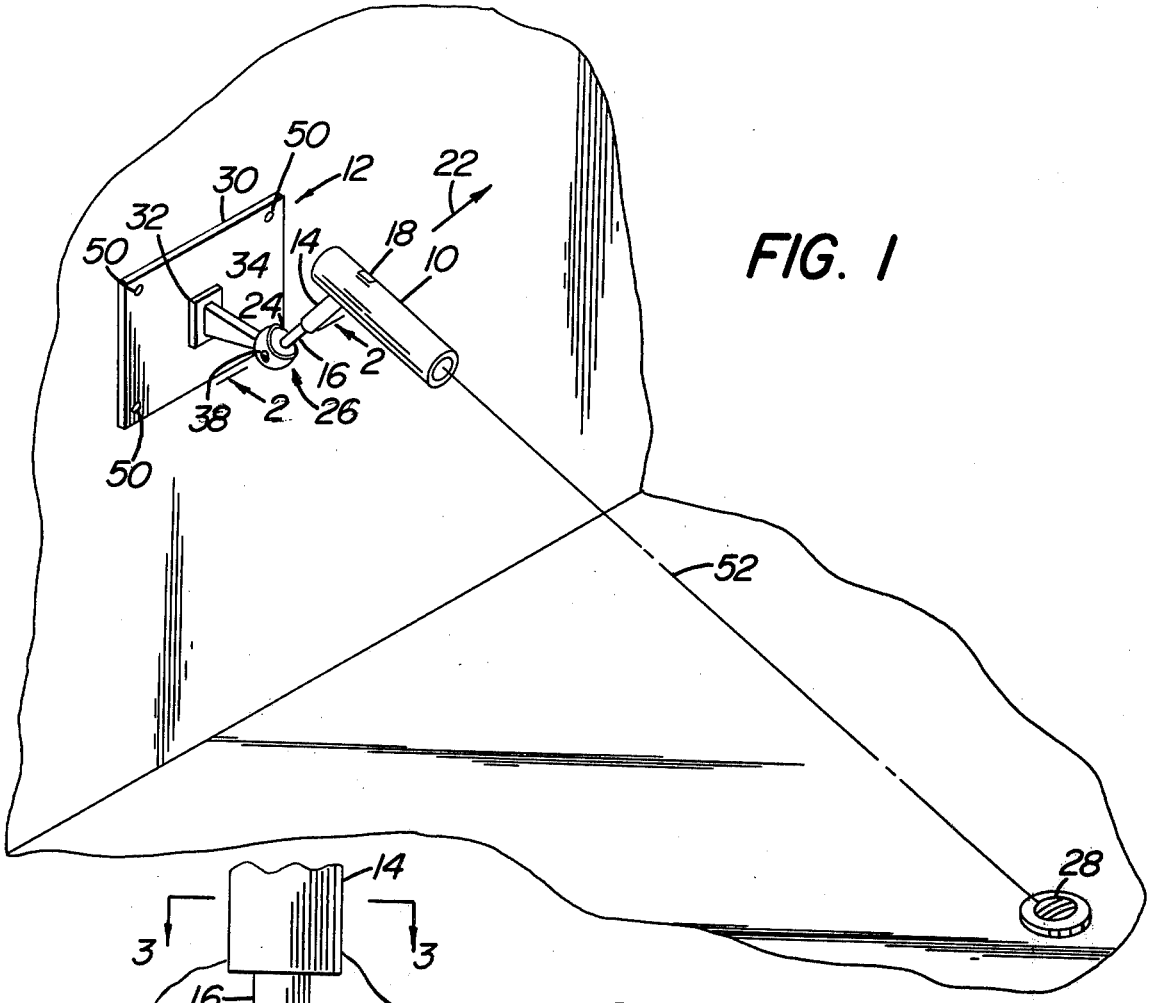
FIG. 1 is a view in perspective of a point locating apparatus in accordance with the present invention.

Referring now to the drawings in detail wherein like numerals indicate like elements, there is shwon in FIG. 1 a point locating apparatus in accordance with the present invention. There is shown in FIG. 1 a collimated light source 10 mounted on bracket means 12. The collimated light source 10 may be any suitable collimated light source, and a low power aiming light source may be preferred. The light source 10 may preferably be a helium/neon laser which shines a visible red beam. Suitable lasers are commercially available, and one such suitable laser is commercially available as a Model 138 manufactured by Coherent Radiation of Palo Alto, Calif.

Figure 3:
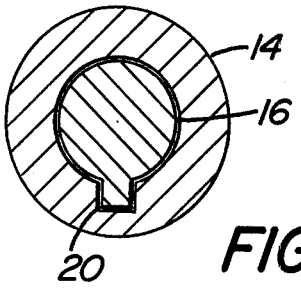
FIG. 3 is a cross sectional view taken along line 3—3 of FIG. 2.

The collimated light source or laser 10 may be powered by means of a battery or other suitable power means. The collimated light source 10 is provided with an on-off switch 18. The collimated light source or laser 10 is provided with a sleeve support 14 having a keyway 20 as is shown in FIG. 3. This sleeve support 14 of the collimated light source 10 mounts on keyed support member or bar 16. Although a particular key and keyway are shown in the drawings, it is understood that any suitable means of preventing rotational motion between sleeve 14 and support member 16 may be used within the scope and spirit of the present invention. For example, any irregular shape of support member 16 with a correspondingly irregular shape on sleeve 14 may be used to prevent such rotary motion. For example, a flattened portion may be provided on support member 16 with a correspondingly formed sleeve 14. The sleeve 14 slideably mounts over support member 16, and the collimated light source 10 may be readily moved by moving the collimated light source 10 in the direction of arrow 22.

Figure 2:
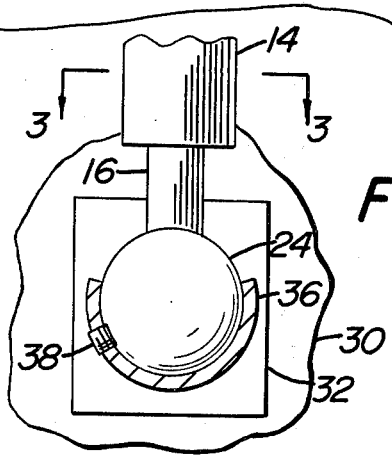
FIG. 2 is a cross sectional view taken along line 2—2 of FIG. 1.

Support member 16 may be mounted to ball 24 of ball and socket 26 as may be seen in FIGS. 1 and 2. Support member 16 is at least partially rotatable in two orthogonal directions thereby allowing the accurate directing of the laser to pin point an object such as a fill pipe 28 or other object as shown in FIG. 1. The ball and socket 26 is supported by bracket 12 which includes a member 30 for mounting on a stationary structure and structures 32 and 34.

The ball 24 of ball and socket 26 is mounted in a socket 36 and is rotatable at least partially in two orthogonal directions to allow positioning of the collimated light source for pointing in the desired direction. Once the collimated light source 10 is pointing in the desired direction, that is to the object to be relocated on subsequent occasions, the position of ball 24 in socket 36 may be locked by means of a set screw 38 or by other suitable means. The set screw may be an Allen type screw or any other suitable type of set screw. Another suitable method of locking the position of the ball within the socket is shown in FIG. 4 which utilizes an adhesive, such as an epoxy type of adhesive.

Figure 4:
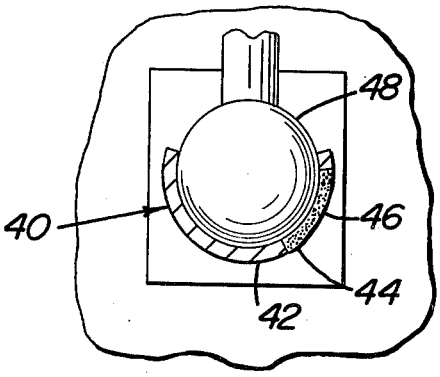
FIG. 4 is a cross sectional view of an alternate embodiment of the present invention corresponding to the view of FIG. 2.

Referring to FIG. 4, there is shown a ball and socket 40 in which the socket 42 is provided with a slot or opening 44 into which an adhesive 46 may be placed thereby locking the ball 48 into a relative position with respect to the socket 42. It is understood that various changes or modifications may be made to structure. For example, it is obvious that support member 16 could be mounted on a socket which would ride over a ball mounted on bracket 12 via elements 32 and 34. It is also understood that other suitable means, other than a ball and socket, may be utilized to position the collimated light source 10 with respect to two orthogonal directions.

In use, mounting member 30 of bracket means 12 may be mounted on a building or other suitable fixed structure by means of nails, screws or other suitable fasteners mounted through one or more of the holes 50. It is preferred that at least two such screws be used to mount the bracket 30. However, it is understood that by placing a short pointed projection on the back side of member 30, one or more of the mounting screws may be eliminated. It is also understood that the member 30 may be adhesively mounted to the structure. However, it is presently preferred that mounting member 30 be mounted to a building or other fixed structure by means of at least two screws or nails.

In use, once the bracket 12 is mounted to a building or other suitable structure, the collimated light source or laser 10 is mounted on bracket 12 by sliding sleeve 14 over support member 16. The collimated light source or laser 10 is turned on by means of on-off switch 18, and the laser is positioned or directed so that the collimated light beam 52 shines on the object to be located, such as fill pipe 28. The laser 10 is then locked in this position by means of set screw 38, or by some other suitable locking means. The laser may then be turned off by means of switch 18 and removed. The laser may be carried with the deliveryman or serviceman in his vehicle.

When the deliveryman or serviceman, or one of his co-workers, returns on a subsequent date, he may readily and accurately locate the object to be located by merely mounting the collimated light source or laser 10 on the bracket 12 and turning the collimated light source 10 on. The collimated light source 10 will then shine a beam of collimated light directly to the object to be located.

The present invention may be embodied in other specific forms without departing from the spirit or essential attributes thereof and, accordingly, reference should be made to the appended claims, rather than to the foregoing specification as indicating the scope of the invention.

I claim:

1. Apparatus for locating a point, such as an oil fill pipe or the like, on a reoccurring basis, comprising: a collimated light source, bracket means having a structure adapted for permanent mounting to a permanent structure in the vicinity of the point to be located on a reoccurring basis, said bracket means including a keyed mounting means for slidably removably mounting a mating portion of said collimated light source, said keyed mounting means being at least partially positionable with respect to two orthogonal directions whereby said collimated light source may be directed at the point to be located in the future, means for locking said keyed mounting means in a predetermined position such that said collimated light source is directed at the point to be relocated when said bracket is permanently mounted to said permanent structure, said collimated light source being slidably removable from said keyed mounting means of said bracket and slidably mountable on said keyed mounting means at a later time when said point is to be relocated.

2. Apparatus in accordance with claim 1 wherein said rotatable keyed mounting means of said bracket means includes a ball and socket at least partially rotatable in two orthogonal directions.

3. Apparatus in accordance with claim 2 wherein said locking means comprises a set screw for locking said socket relative to said ball.

4. Apparatus in accordance with claim 2 wherein said locking means comprises slots in said socket for application of an adhesive for locking said socket relative to said ball.

5. Apparatus in accordance with claim 1 wherein said collimated light source is a laser.

6. Apparatus in accordance with claim 5 wherein said laser is a helium/neon laser.

7. Apparatus in accordance with claim 5 wherein said laser provides a colored light output.

8. A method for locating a point, such as an oil fill pipe or the like, on a reoccurring basis, comprising the steps of: locating the point to be located on a reoccurring basis; locating a permanent structure in the vicinity of said point for the mounting of bracket means for supporting a collimated light source; permanently mounting a bracket means having a positionable keyed mounting means to said permanent structure; slidably removably mounting a mating portion of a collimated light source on said positionable keyed mounting means of said bracket means; adjusting said positionable keyed mounting means in two orthogonal directions so that a light beam of said collimated light source is directed onto the point to be located on a reoccurring basis; and slidably removing said collimated light source whereby said collimated light source may be slidably mounted on said locked keyed mounting means at a later time to relocate said point.

9. A method in accordance with claim 8 wherein said locking step is comprised of tightening a set screw for locking a socket relative to a ball of a ball and socket of said bracket means.

10. A method in accordance with claim 8 wherein said locking step is comprised of the application of an adhesive for locking a socket relative to a ball of a ball and socket of said bracket means.

* * * * *